US007880693B2

(12) United States Patent
Minami

(10) Patent No.: US 7,880,693 B2
(45) Date of Patent: Feb. 1, 2011

(54) DISPLAY

(75) Inventor: Tetsuo Minami, Tokyo (JP)

(73) Assignee: Sony Corporation, Tokyo (JP)

( * ) Notice: Subject to any disclaimer, the term of this patent is extended or adjusted under 35 U.S.C. 154(b) by 865 days.

(21) Appl. No.: 11/819,403

(22) Filed: Jun. 27, 2007

(65) Prior Publication Data

US 2008/0018567 A1 Jan. 24, 2008

(30) Foreign Application Priority Data

Jul. 20, 2006 (JP) ..... 2006-197788
Jul. 20, 2006 (JP) ..... 2006-197789

(51) Int. Cl.
*G09G 3/00* (2006.01)

(52) U.S. Cl. ..... 345/76; 345/82; 345/204; 345/211; 315/169.3; 349/148

(58) Field of Classification Search ..... 345/76–77, 345/80, 82–83, 204–206, 208–209, 211; 315/169.3; 349/139, 148
See application file for complete search history.

(56) References Cited

U.S. PATENT DOCUMENTS 5,621,439 A * 4/1997 Okada et al. ..... 345/211
5,684,365 A 11/1997 Tang et al.
6,052,169 A * 4/2000 Kim ..... 349/148
6,229,506 B1 * 5/2001 Dawson et al. ..... 345/82
6,661,413 B2 * 12/2003 Sakaguchi ..... 345/211
7,164,405 B1 * 1/2007 Jeong et al. ..... 345/94
7,199,808 B2 * 4/2007 Yo ..... 345/694
7,286,106 B2 * 10/2007 Komiya et al. ..... 345/82
7,403,177 B2 * 7/2008 Tanada et al. ..... 345/76
7,692,610 B2 * 4/2010 Kimura ..... 345/76
2003/0137503 A1 * 7/2003 Kimura et al. ..... 345/212
2004/0222746 A1 * 11/2004 Winters ..... 315/167
2005/0052368 A1 * 3/2005 Kim ..... 345/76
2006/0139256 A1 * 6/2006 Adachi ..... 345/76
2006/0244690 A1 * 11/2006 Osame et al. ..... 345/76
2006/0273994 A1 * 12/2006 Sun ..... 345/76
2006/0290859 A1 * 12/2006 Ko et al. ..... 349/139
2007/0273583 A1 * 11/2007 Rosenberg ..... 342/367
2008/0007683 A1 * 1/2008 Makida ..... 349/139
2008/0143264 A1 * 6/2008 Minami et al. ..... 315/169.3

FOREIGN PATENT DOCUMENTS

JP 08-234683 9/1996
WO WO 2006/006376 * 1/2006

* cited by examiner

*Primary Examiner*—Lun-Yi Lao
(74) *Attorney, Agent, or Firm*—Rader, Fishman & Grauer PLLC

(57) ABSTRACT

According to an embodiment of the present invention, there is provided a display that includes a plurality of pixel circuits, a scanner, and a drive interconnect. The plurality of pixel circuits are arranged in a matrix and each includes at least one transistor of which the conduction state is controlled through the reception of a drive signal to a control terminal. The scanner outputs a drive signal to the control terminals of the transistors included in the pixel circuits. The drive interconnect is connected to the control terminals of the transistors in the pixel circuits in common and allows transmission of a drive signal output by the scanner. The drive interconnect includes a configuration that averages signal delay due to interconnect resistance differences dependent upon the distance from a drive signal output terminal of the scanner.

15 Claims, 17 Drawing Sheets

DS

WS

AZ1

AZ2

ND112

ND111
1F
1H
Vth CORRECTION PERIOD
Vth CORRECTION PERIOD
MOBILITY CORRECTION PERIOD
MOBILITY CORRECTION PERIOD
Vcc
Vcc
Vsig
Vsig
Vss1
Vss1
Vth
Vth
Vss2
Vss2

DISPLAY

CROSS REFERENCES TO RELATED APPLICATIONS

The present invention contains subject matter related to Japanese Patent Application JP 2006-197788 filed with the Japan Patent Office on Jul. 20, 2006, and Japanese Patent Application JP 2006-197789 filed with the Japan Patent Office on Jul. 20, 2006, the entire contents of which being incorporated herein by references.

BACKGROUND OF THE INVENTION

1. Field of the Invention

The present invention relates to displays, such as organic electroluminescence (EL) displays, in which pixel circuits, each having an electro-optical element of which luminance is controlled based on a current value, are arranged in a matrix, and particularly to so-called active-matrix displays in which the value of the current flowing through an electro-optical element is controlled by insulated-gate field effect transistors provided in each pixel circuit.

2. Description of the Related Art

In an image display, e.g., in a liquid crystal display, a large number of pixels are arranged in a matrix, and the light intensity is controlled on each pixel basis in accordance with information on an image to be displayed, to thereby display the image.

This pixel-by-pixel control is similarly implemented in an organic EL display and the like. The organic EL display has a light-emitting element in each pixel circuit, and therefore is a so-called self-luminous display. The organic EL display has the following advantages over the liquid crystal display: higher image visibility, no necessity for a backlight, and higher response speed.

Furthermore, the organic EL display is greatly different from the liquid crystal display and the like, in that a color grayscale is obtained through control of the luminance of each light-emitting element based on the value of the current flowing through the light-emitting element, i.e., the light-emitting elements are current-control elements.

The kinds of drive systems for the organic EL display include a simple-matrix system and an active-matrix system similar to the liquid crystal display. The simple-matrix system has a simpler configuration but involves problems such as a difficulty in the realization of a large-size, high-definition display. Therefore, currently, the active-matrix system is being developed more actively. In the active-matrix system, the current that flows through a light-emitting element in each pixel circuit is controlled by active elements, typically by thin film transistors (TFTs), provided in the pixel circuit.

FIG. 1 is a block diagram showing the configuration of a typical organic EL display.

As shown in FIG. 1, a display 1 includes a pixel array part 2 in which pixel circuits (PXLC) 2*a* are arranged in an m×n matrix, a horizontal selector (HSEL) 3, and a write scanner (WSCN) 4. Furthermore, the display 1 includes data lines DTL1 to DTLn that are selected by the horizontal selector 3 and supplied with data signals in accordance with luminance information, and scan lines WSL1 to WSLm that are selected and driven by the write scanner 4.

The horizontal selector 3 and the write scanner 4 are formed on polycrystalline silicon in some cases, and are formed in the periphery of pixels as MOSICs or the like in other cases.

FIG. 2 is a circuit diagram showing one configuration example of the pixel circuit 2*a* of FIG. 1 (refer to e.g. U.S. Pat. No. 5,684,365 and Japanese Patent Laid-Open No. 8-234683).

The pixel circuit of FIG. 2 has the simplest circuit configuration among a large number of proposed circuits, and is based on a so-called two-transistor drive system.

The pixel circuit 2*a* of FIG. 2 includes a p-channel thin-film field effect transistor (hereinafter, referred to as a TFT) 11, a p-channel TFT 12, a capacitor C11, and an organic EL element (OLED) 13 as a light-emitting element. Furthermore, in FIG. 2, DTL and WSL denote a data line and a scan line, respectively.

The organic EL element has a rectification function in many cases, and therefore, is often referred to as an OLED (Organic Light Emitting Diode). Although a diode symbol is used for representation of a light-emitting element in FIG. 2 and other drawings, the OLED in the following description does not necessarily need to have a rectification function.

In FIG. 2, the source of the TFT 11 is connected to a supply potential Vcc, and the cathode of the light-emitting element 13 is connected to a ground potential GND. The pixel circuit 2*a* of FIG. 2 operates as follows.

Step ST1:

When the scan line WSL is turned to the selected state (to a low level, in this example) and a writing potential Vdata is applied to the data line DTL, the TFT 12 conducts, and thus, the capacitor C11 is charged or discharged, so that the gate potential of the TFT 11 becomes Vdata.

Step ST2:

When the scan line WSL is turned to the non-selected state (to a high level, in this example), the data line DTL is electrically isolated from the TFT 11. However, the gate potential of the TFT 11 is stably held by the capacitor C11.

Step ST3:

The current that flows through the TFT 11 and the light-emitting element 13 has a current value dependent upon the voltage Vgs between the gate and source of the TFT 11, and the light-emitting element 13 continues to emit light with luminance dependent upon this current value.

Hereinafter, the operation of selecting the scan line WSL to thereby transmit luminance information supplied to the data line to the inside of a pixel, like that of the step ST1, will be expressed by using a verb "write".

In the pixel circuit 2*a* of FIG. 2, after the potential Vdata is written, the light-emitting element 13 continues to emit light with constant luminance until the next rewriting of the potential.

As described above, in the pixel circuit 2*a*, the voltage applied to the gate of the TFT 11 as a drive transistor is varied to control the value of the current flowing through the EL light-emitting element 13.

Because the source of the p-channel drive transistor is connected to the supply potential Vcc, the TFT 11 typically operates in the saturation region. Therefore, the TFT 11 serves as a constant current source for a current having a value represented by Equation (1).

(Equation 1)

$$Ids = \tfrac{1}{2} \cdot \mu (W/L) \mathrm{Cox} (Vgs - |Vth|)^2 \quad (1)$$

In Equation (1), μ denotes the carrier mobility, Cox denotes the gate capacitance per unit area, and W and L denote the gate width and gate length, respectively. In addition, Vgs denotes the voltage between the gate and source of the TFT 11, and Vth denotes the threshold voltage of the TFT 11.

In a simple-matrix image display, each light-emitting element emits light only at the moment of being selected. In contrast, in the active-matrix system, each light-emitting element also continues to emit light after completion of writing as described above. Therefore, the active-matrix system is advantageous in driving a large-size and high-definition display in particular, because the active-matrix system can decrease the peak luminance and peak current of the light-emitting elements compared with the simple-matrix system.

FIG. 3 is a diagram showing a change of the current-voltage (I-V) characteristic of an organic EL element over time. In FIG. 3, the full-line curve indicates the characteristic of the initial state, while the dashed-line curve indicates the characteristic after the change over time.

In general, the I-V characteristic of an organic EL element deteriorates with elapse of time as shown in FIG. 3.

However, the two-transistor driving of FIG. 2 is constant-current driving, and therefore, a constant current continues to flow through the organic EL element, as described above. Thus, even when the I-V characteristic of the organic EL element deteriorates, the light-emission luminance thereof does not change over time.

The pixel circuit 2*a* of FIG. 2 is formed of p-channel TFTs. If the pixel circuit 2*a* can be formed of n-channel TFTs, an existing amorphous silicon (a-Si) process can be used for TFT fabrication. This can reduce the cost of the TFT substrate.

A description will be made below about a basic pixel circuit obtained by replacing the transistors by n-channel TFTs.

FIG. 4 is a circuit diagram showing the pixel circuit obtained by replacing the p-channel TFTs in the circuit of FIG. 2 by n-channel TFTs.

A pixel circuit 2*b* of FIG. 4 includes n-channel TFTs 21 and 22, a capacitor C21, and an organic EL element (OLED) 23 as a light-emitting element. Furthermore, in FIG. 4, DTL and WSL denote a data line and a scan line, respectively.

In this pixel circuit 2*b*, the drain side of the TFT 21 as a drive transistor is connected to a supply potential Vcc, and the source thereof is connected to the anode of the EL element 23, so that a source follower circuit is formed.

FIG. 5 is a diagram showing the operating point of the TFT 21 as the drive transistor and the EL element 23 in the initial state. In FIG. 5, the abscissa indicates the voltage Vds between the drain and source of the TFT 21, while the ordinate indicates the current Ids between the drain and source of the TFT 21.

As shown in FIG. 5, the source voltage is determined by the operating point of the TFT 21 as the drive transistor and the EL element 23, and differs depending on the gate voltage.

Because the TFT 21 is driven in the saturation region, the TFT 21 outputs the current Ids with a current value in accordance with Equation (1), derived from the voltage Vgs corresponding to the source voltage of the operating point.

SUMMARY OF THE INVENTION

The above-described pixel circuit is the simplest circuit. However, a practical circuit includes also a drive transistor connected in series to an OLED, and TFTs for cancelling the mobility and threshold voltage.

For these TFTs, gate pulses are generated by vertical scanners disposed on both the sides or on a single side of the active-matrix organic EL display panel, so that the pulse signals are applied via interconnects to the gates of desired TFTs in pixel circuits arranged in a matrix.

When the number of the TFTs to which the pulse signals are applied in each pixel circuit is two or more, the timings of the application of the respective pulse signals are important.

However, as shown in FIG. 6, due to the influence of interconnect resistance r of an interconnect 41 that applies pulse signals to the gates of transistors (TFTs) in the pixel circuits 2*a* via a buffer 40 at the final stage of the write scanner, delay of the pulses and a change in the transient occur. This causes timing errors, which results in the occurrence of shading and streak unevenness.

The resistance of the interconnect to the gate of the transistor in the pixel circuit 2*a* increases as the distance between the transistor and the scanner becomes larger.

Consequently, between the pixel circuits on both the end sides of the panel, e.g. a difference in the mobility correction period arises, which causes a luminance difference.

Furthermore, due to errors from the optimum mobility correction period, pixels for which mobility variation may not be corrected completely appear, and these pixels are visually recognized as streaks disadvantageously.

There is a need for the present invention to provide a display that can suppress the occurrence of shading and streak unevenness attributed to the resistance of an interconnect for gate pulses.

According to a first embodiment of the present invention, there is provided a display that includes a plurality of pixel circuits, a scanner, and a drive interconnect. The plurality of pixel circuits are configured to be arranged in a matrix, and each includes at least one transistor of which the conduction state is controlled through reception of a drive signal to a control terminal. The scanner is configured to output a drive signal to the control terminals of the transistors included in the pixel circuits. The drive interconnect is configured to be connected to the control terminals of the transistors in the pixel circuits in common and allow transmission of a drive signal output by the scanner. The drive interconnect includes a configuration that averages signal delay due to interconnect resistance differences dependent upon the distance from a drive signal output terminal of the scanner.

According to a second embodiment of the present invention, there is provided a display that includes a plurality of pixel circuits, data lines, first, second, third, and fourth scanners, first, second, third, and fourth drive interconnects, and first, second, third, and fourth reference potentials. The plurality of pixel circuits are configured to be arranged in a matrix and each include a transistor of which the conduction state is controlled through the reception of a drive signal to a gate. The data lines are configured to be disposed along columns of the matrix of the pixel circuits and be supplied with a data signal in accordance with luminance information. The first, second, third, and fourth scanners are configured to output a drive signal to the gates of the transistors included in the pixel circuits. The first, second, third, and fourth drive interconnects are configured to be connected to the gates of the transistors in the pixel circuits on the same row in common and allow transmission of a drive signal output by the firsts second, third, and fourth scanners, respectively. Each of the pixel circuits includes an electro-optical element, first and second nodes, a pixel capacitance element, a drive transistor, a first switch transistor, a second switch transistor, a third switch transistor, and a fourth switch transistor. The luminance of the electro-optical element changes depending on a current that flows through the electro-optical element. The pixel capacitance element is connected between the first node and the second node. The drive transistor forms a current supply line between a drain terminal and a source terminal, and controls a current flowing through the current supply line depending on the potential of a gate connected to the second node. The first switch transistor is connected between the first reference potential and the drain terminal of the drive transistor. The second switch transistor is connected between the first node and the third reference potential. The third switch transistor is connected between the second node and the fourth reference potential. The fourth switch transistor is connected between the data line and the second node. The first switch transistor, the current supply line of the drive transistor, the first node, and the electro-optical element are connected in series to each other between the first reference potential and the second reference potential. The first drive interconnect is connected to a gate of the first switch transistor. The second drive interconnect is connected to a gate of the fourth switch transistor. The third drive interconnect is connected to a gate of the second switch transistor. The fourth drive interconnect is connected to a gate of the third switch transistor. At least one drive interconnect out of the first to fourth drive interconnects includes a configuration that averages the signal delay due to interconnect resistance differences dependent upon the distance from a drive signal output terminal of the scanner.

According to a third embodiment of the present invention, there is provided a display that includes a plurality of pixel circuits, a scanner, and a drive interconnect. The plurality of pixel circuits are configured to be arranged in a matrix and each include at least one transistor of which the conduction state is controlled through the reception of a drive signal to a control terminal. The scanner is configured to output a drive signal to the control terminals of the transistors included in the pixel circuits. The drive interconnect is configured to be connected to the control terminals of the transistors in the pixel circuits in common and allow transmission of a drive signal output by the scanner. The drive interconnect is divided into a plurality of interconnects along the interconnect direction.

According to a fourth embodiment of the present invention, there is provided a display that includes a plurality of pixel circuits, data lines, first, second, third, and fourth scanners, first, second, third, and fourth drive interconnects, and first, second, third, and fourth reference potentials. The plurality of pixel circuits are configured to be arranged in a matrix and each include a transistor of which the conduction state is controlled through the reception of a drive signal to a gate. The data lines are configured to be disposed along columns of the matrix of the pixel circuits and be supplied with a data signal in accordance with luminance information. The first, second, third, and fourth scanners are configured to output a drive signal to the gates of the transistors included in the pixel circuits. The first, second, third, and fourth drive interconnects are configured to be connected to the gates of the transistors in the pixel circuits on the same row in common and allow transmission of a drive signal output by the first, second, third, and fourth scanners, respectively. Each of the pixel circuits includes an electro-optical element, first and second nodes, a pixel capacitance element, a drive transistor, a first switch transistor, a second switch transistor, a third switch transistor, and a fourth switch transistor. The luminance of the electro-optical element changes depending on a current that flows through the electro-optical element. The pixel capacitance element is connected between the first node and the second node. The drive transistor forms a current supply line between a drain terminal and a source terminal, and controls a current flowing through the current supply line depending on the potential of a gate connected to the second node. The first switch transistor is connected between the first reference potential and the drain terminal of the drive transistor. The second switch transistor is connected between the first node and the third reference potential. The third switch transistor is connected between the second node and the fourth reference potential. The fourth switch transistor is connected between the data line and the second node. The first switch transistor, the current supply line of the drive transistor, the first node, and the electro-optical element are connected in series to each other between the first reference potential and the second reference potential. The first drive interconnect is connected to a gate of the first switch transistor. The second drive interconnect is connected to a gate of the fourth switch transistor. The third drive interconnect is connected to a gate of the second switch transistor. The fourth drive interconnect is connected to a gate of the third switch transistor. At least one drive interconnect out of the first to fourth drive interconnects is divided into a plurality of interconnects along the interconnect direction.

The embodiments of the present invention can suppress the occurrence of shading and streak unevenness attributed to the resistance of an interconnect for gate pulses.

DETAILED DESCRIPTION OF THE PREFERRED EMBODIMENTS

Embodiments of the present invention will be described below in association with the drawings.

Figure 1:
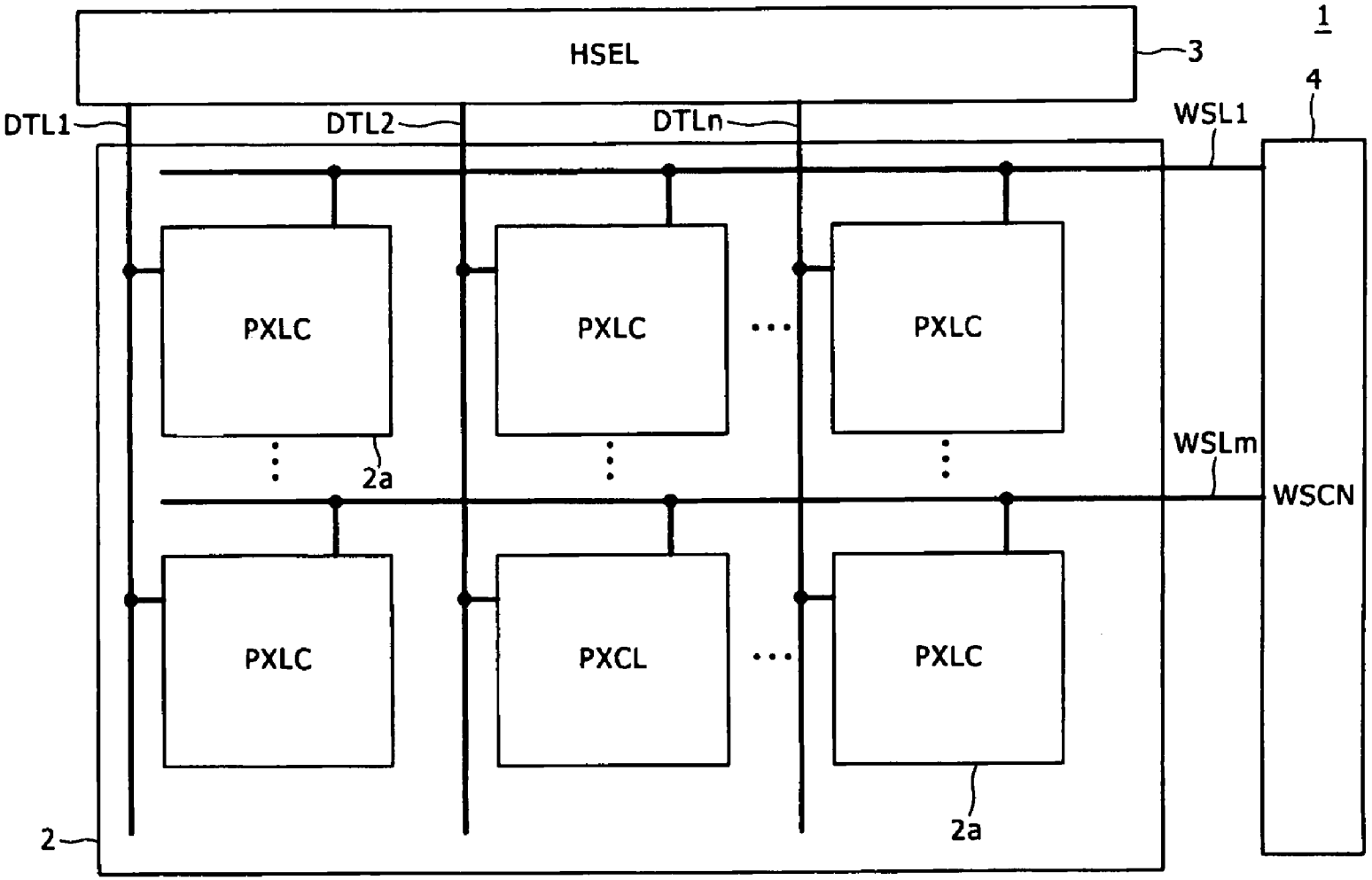
RELATED ART FIG. 1
FIG. 1 is a block diagram showing the configuration of a typical organic EL display.
Figure 2:
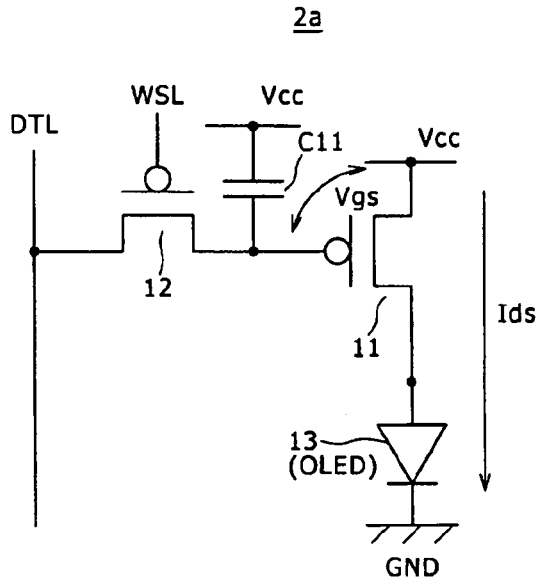
FIG. 2 RELATED ART
FIG. 2 is a circuit diagram showing one configuration example of a pixel circuit of FIG. 1.
Figure 3:
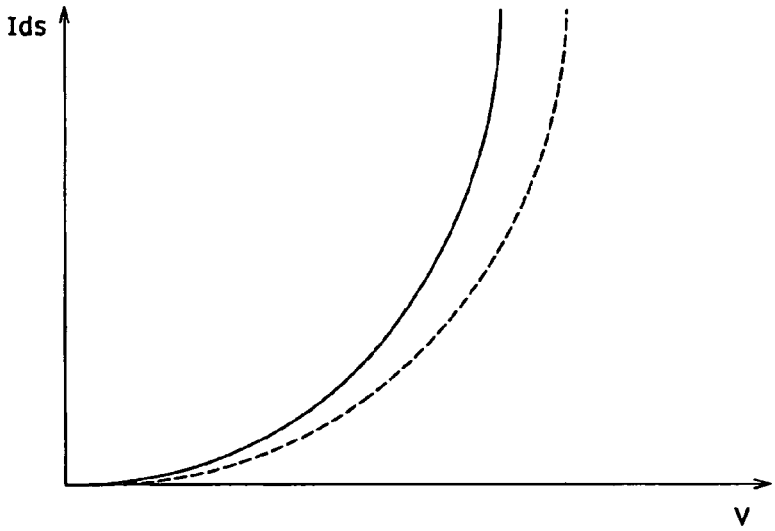
FIG. 3 is a diagram showing a change of the current-voltage (I-V) characteristic of an organic EL element over time.
Figure 4:
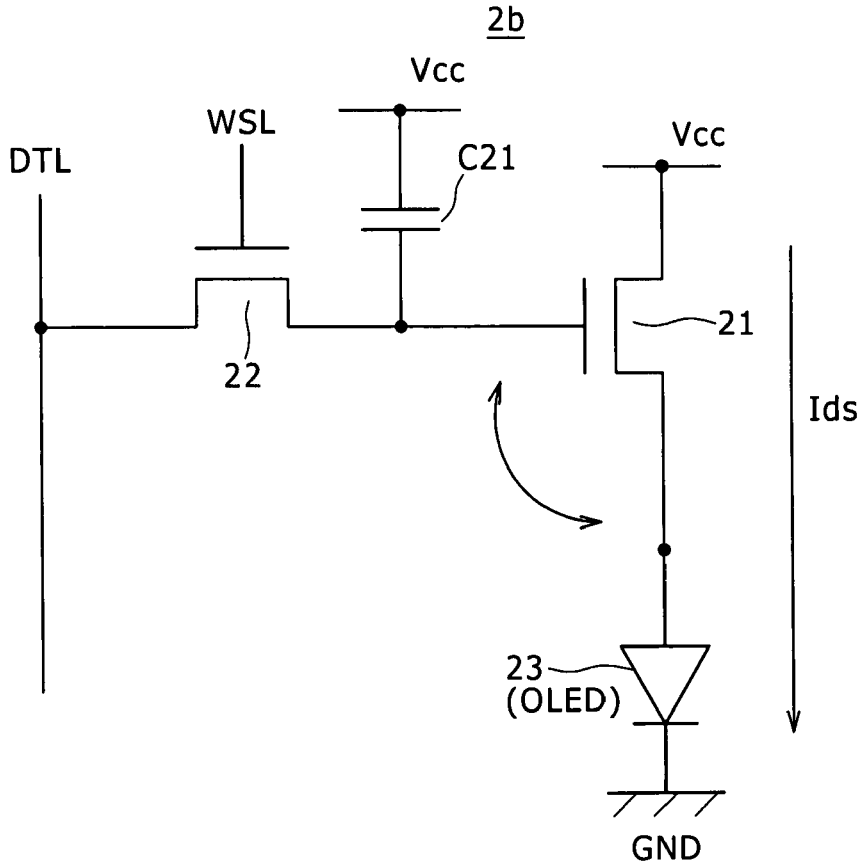
FIG. 4 is a circuit diagram showing a pixel circuit obtained by replacing p-channel TFTs in the circuit of FIG. 2 by n-channel TFTs.
Figure 5:
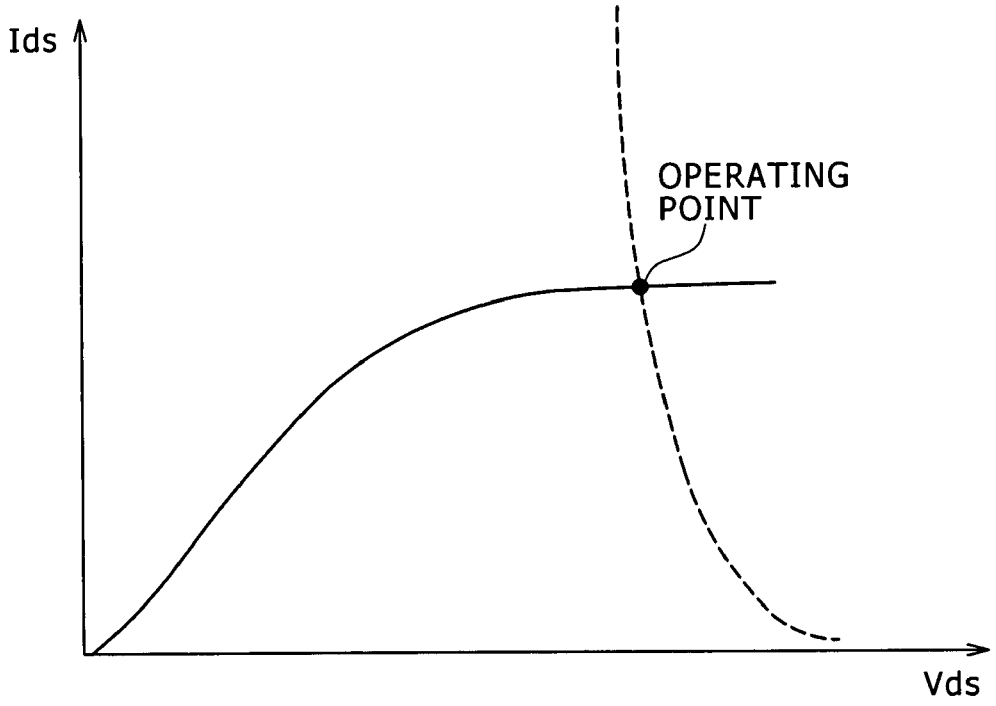
FIG. 5 is a diagram showing the operating point of a TFT as a drive transistor and an EL element in the initial state.
Figure 6:
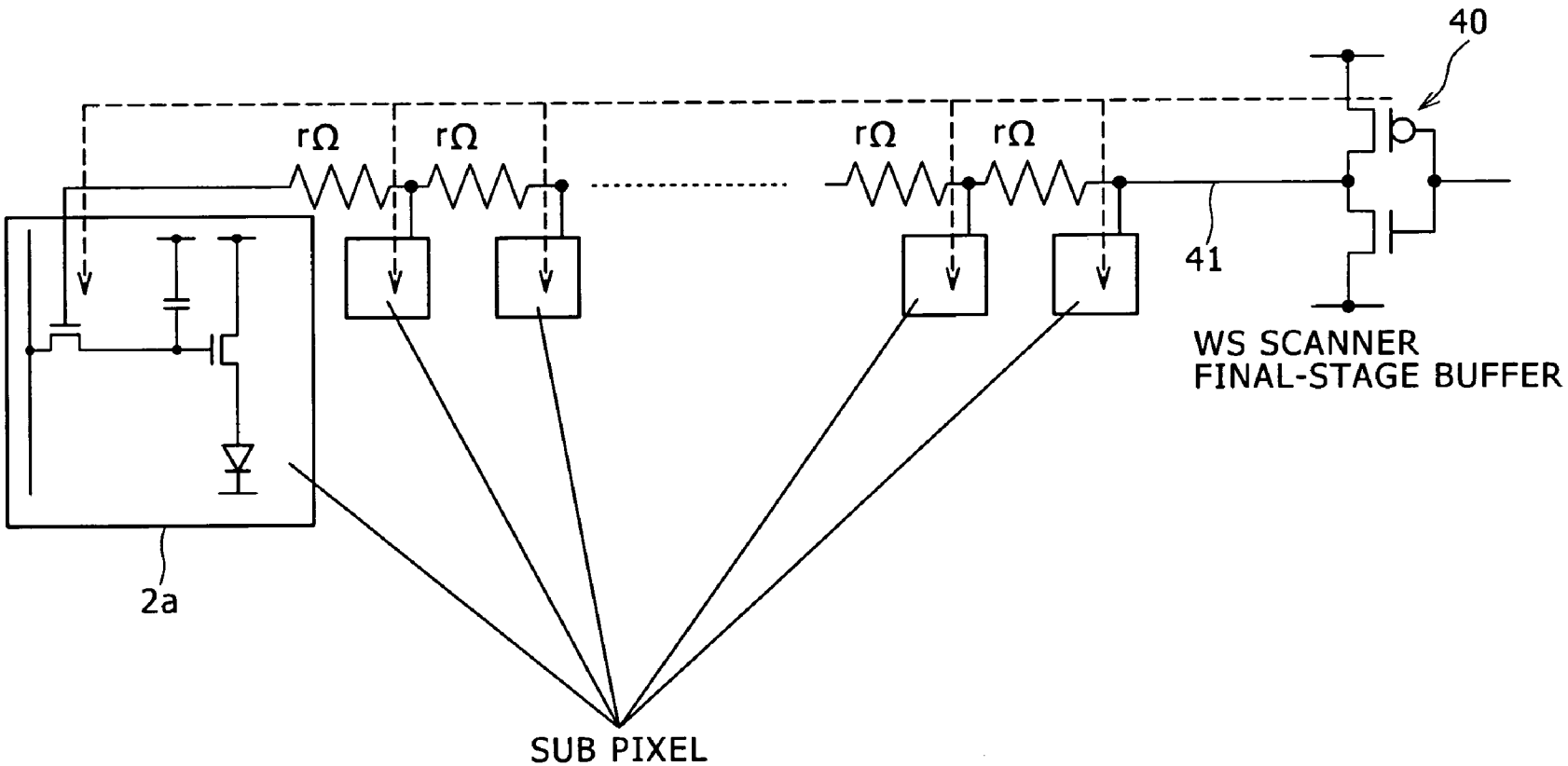
FIG. 6 is a diagram for explaining a disadvantage due to interconnect resistance.
Figure 7:
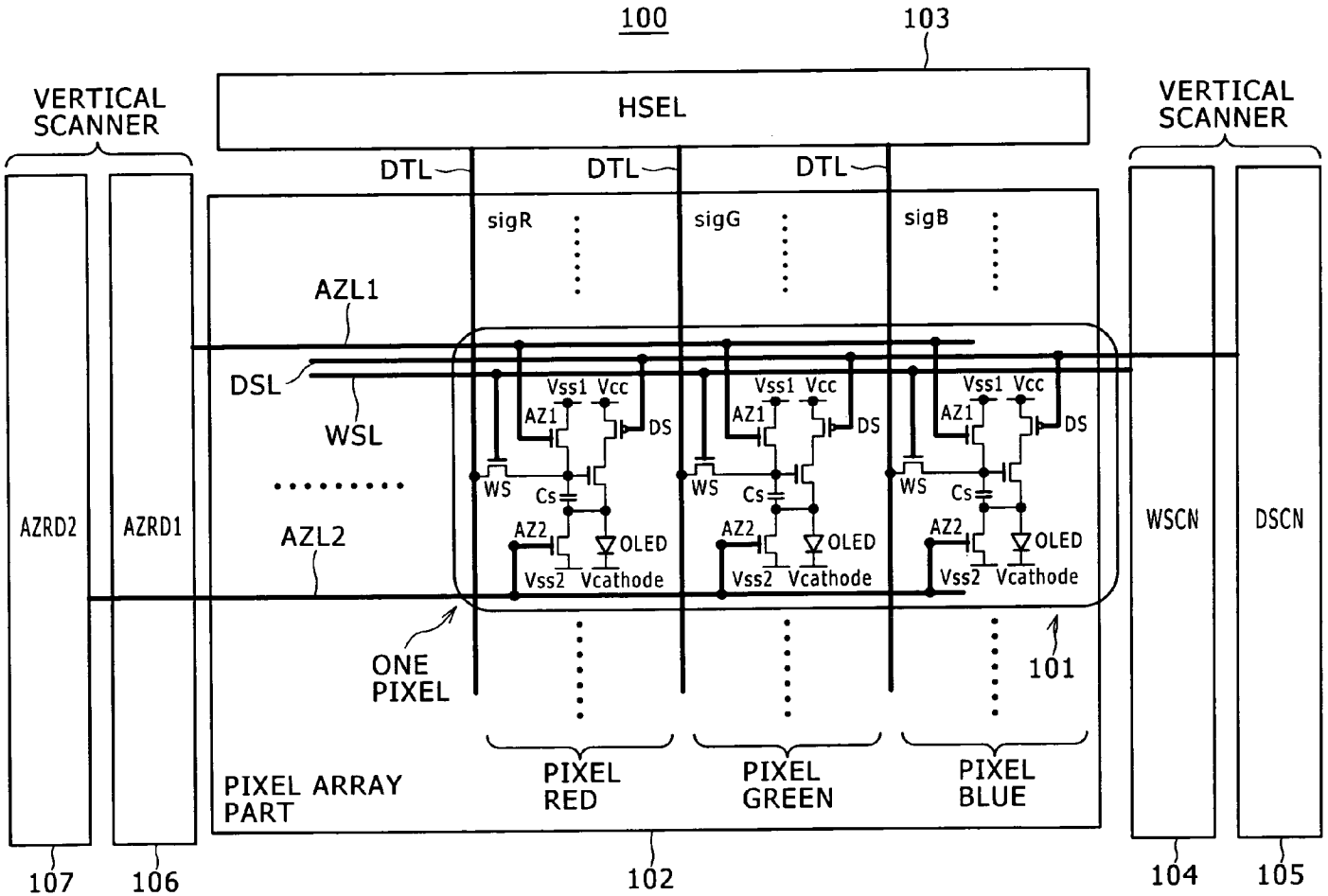
FIG. 7 is a block diagram showing the configuration of an organic EL display that employs pixel circuits according to an embodiment of the present invention.

FIG. 7 is a block diagram showing the configuration of an organic EL display that employs pixel circuits according to an embodiment of the present invention.

Figure 8:
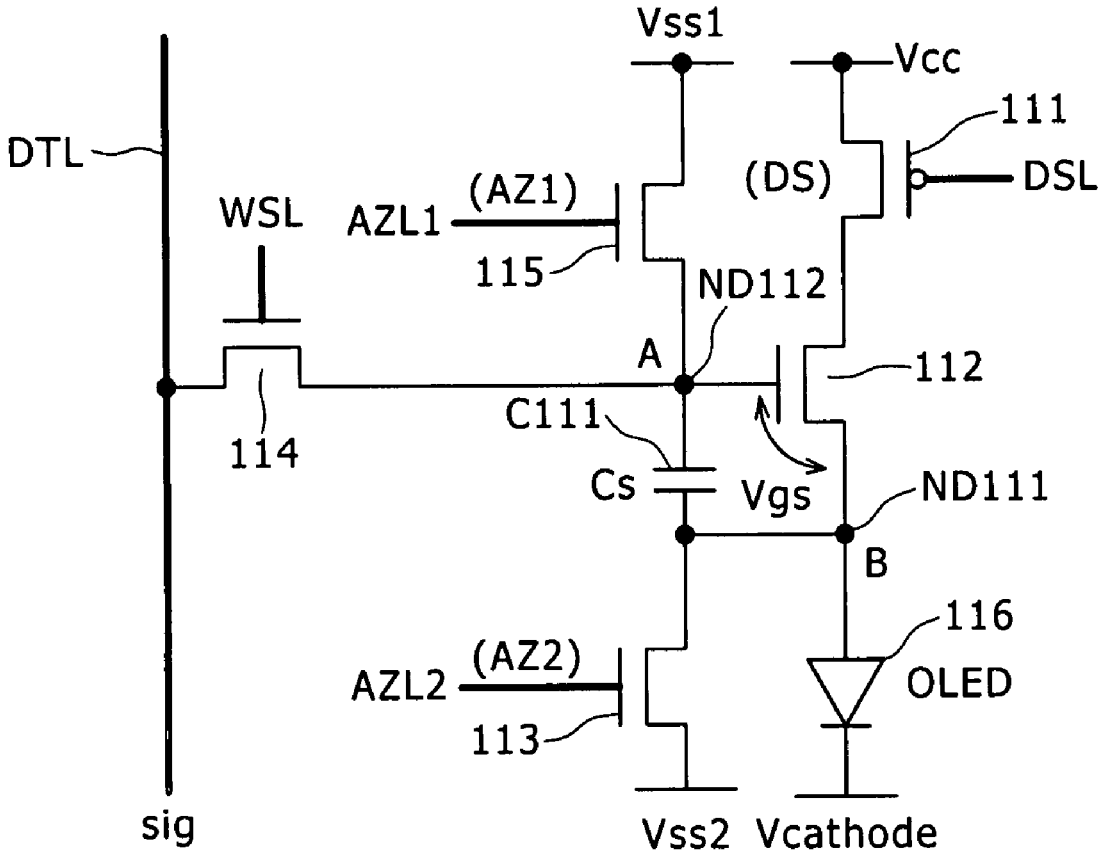
FIG. 8 is a circuit diagram showing the specific configuration of the pixel circuit according to the embodiment.

FIG. 8 is a circuit diagram showing the specific configuration of the pixel circuit according to the embodiment.

As shown in FIGS. 7 and 8, a display 100 includes a pixel array part 102 in which pixel circuits 101 are arranged in an m×n matrix, a horizontal selector (HSEL) 103, a write scanner (WSCN) 104, a drive scanner (DSCN) 105, a first auto-zero circuit (AZRD1) 106, and a second auto-zero circuit (AZRD2) 107. In addition, the display 100 also includes data lines DTL that are selected by the horizontal selector 103 and supplied with data signals in accordance with luminance information, scan lines WSL that are selected and driven by the write scanner 104 as the second drive interconnects, and drive lines DSL that are selected and driven by the drive scanner 105 as the first drive interconnects. Moreover, the display 100 further includes first auto-zero lines AZL1 that are selected and driven by the first auto-zero circuit 106 as the fourth drive interconnects and second auto-zero lines AZL2 that are selected and driven by the second auto-zero circuit 107 as the third drive interconnects.

As shown in FIGS. 7 and 8, the pixel circuit 101 according to the present embodiment includes a p-channel TFT 111, n-channel TFTs 112 to 115, a capacitor C111, a light-emitting element 116 formed of an organic EL element (OLED: electro-optical element), a first node ND111, and a second ND112.

The TFT 111 serves as the first switch transistor, and the TFT 113 serves as the second switch transistor. Furthermore, the TFT 115 serves as the third switch transistor, and the TFT 114 serves as the fourth switch transistor.

A supply line for a supply voltage Vcc (supply potential) is equivalent to the first reference potential, and a ground potential GND is equivalent to the second reference potential. Furthermore, a potential Vss1 is equivalent to the fourth reference potential, and a potential Vss2 is equivalent to the third reference potential.

In the pixel circuit 101, between the first reference potential (the supply potential Vcc in the present embodiment) and the second reference potential (the ground potential GND in the present embodiment), the TFT 111, the TFT 112 as a drive transistor, the first node ND111, and the light-emitting element (OLED) 116 are connected in series to each other. Specifically, the cathode of the light-emitting element 116 is connected to the ground potential GND, and the anode thereof is connected to the first node ND111. The source of the TFT 112 is connected to the first node ND111, and the drain thereof is connected to the drain of the TFT 111. The source of the TFT 111 is connected to the supply potential Vcc.

Furthermore, the gate of the TFT 112 is connected to the second node ND112, and the gate of the TFT 111 is connected to the drive line DSL.

The drain of the TFT 113 is connected to the first node ND111 and a first electrode of the capacitor C111, and the source thereof is connected to the fixed potential Vss2. The gate of the TFT 113 is connected to the second auto-zero line AZL2. A second electrode of the capacitor C111 is connected to the second node ND112.

The source and drain of the TFT 114 are connected to the data line DTL and the second node ND112, respectively. The gate of the TFT 114 is connected to the scan line WSL.

Furthermore, the source and drain of the TFT 115 are connected to the second node ND112 and the predetermined potential Vss1, respectively. The gate of the TFT 115 is connected to the first auto-zero line AZL1.

In this manner, in the pixel circuit 101 according to the present embodiment, the capacitor C111 as a pixel capacitance element is connected between the gate and source of the TFT 112 as the drive transistor. In a non-emission period, the source of the TFT 112 is connected to a fixed potential via the TFT 113 as a switch transistor and the gate and drain of the TFT 112 are connected to each other, to thereby correct the threshold voltage Vth.

Furthermore, in the display 100 according to the present embodiment, in order to suppress shading and streak unevenness attributed to pulse delay caused by the interconnect resistance of the interconnect that applies drive pulses to the gates of TFTs (transistors) in the pixel circuits 101, the resistance of the interconnect to the gate of the TFT in the pixel is adjusted as follows. Specifically, the closer the gate is to the final stage (output stage) of the vertical scanner, the larger the resistance is set. In contrast, the remoter the gate is from the final stage, the smaller the resistance is set.

This countermeasure against shading and streak unevenness is implemented for at least one of the scan line WSL and the drive line DSL, out of the scan line WSL, the drive line DSL, and the auto-zero lines AZL1 and AZL2.

Examples of this countermeasure will be described below. In the examples to be described below, the countermeasure is implemented for the scan line WSL.

Figure 9:
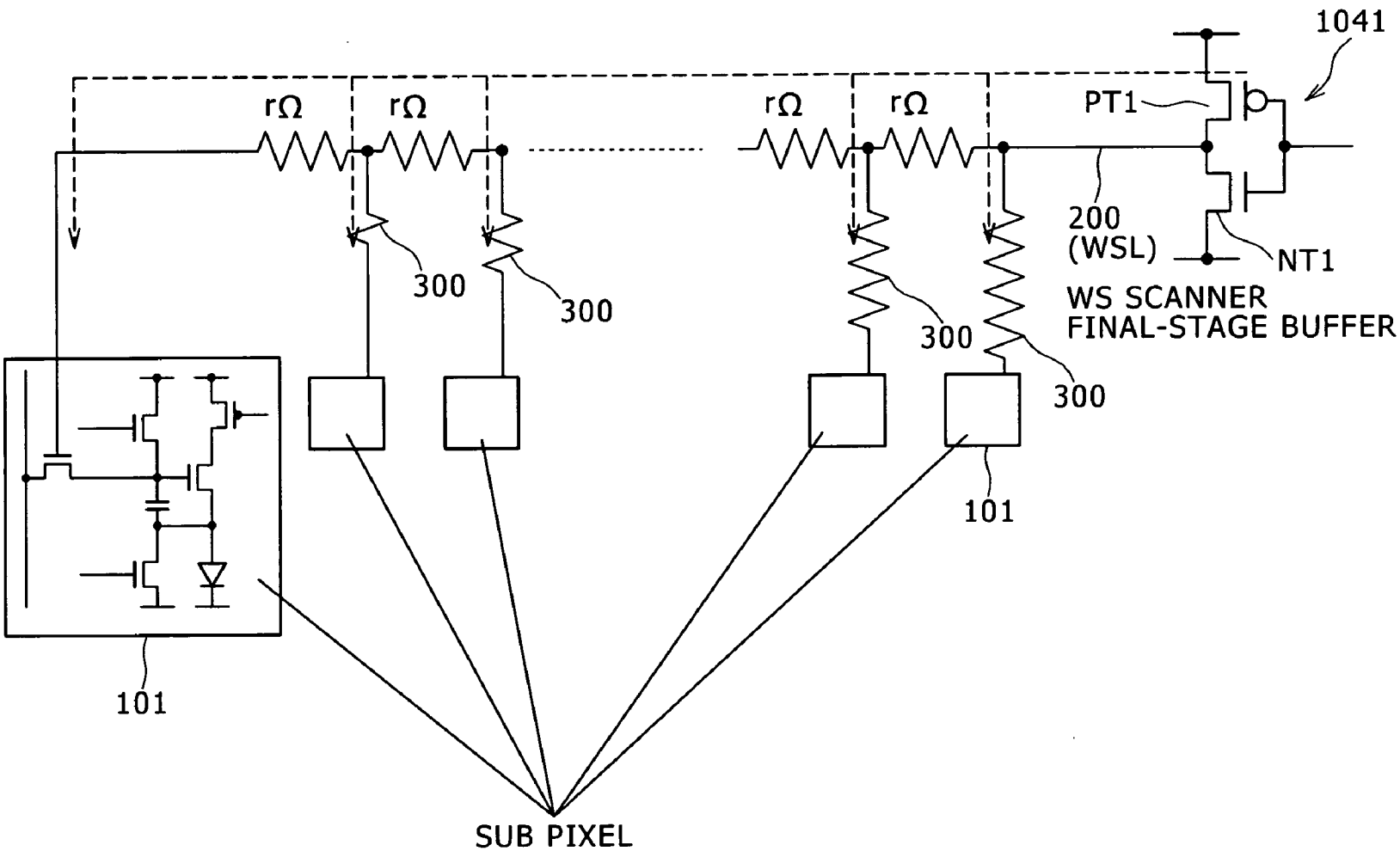
FIG. 9 is a diagram for explaining a first example of a countermeasure to suppress shading and streak unevenness.

FIG. 9 is a diagram for explaining a first example of the countermeasure to suppress shading and streak unevenness.

In FIG. 9, numeral 1041 denotes a buffer at the final stage (output stage) of a write scanner 104. This buffer is provided as a CMOS buffer formed of a PMOS transistor PT1 and an NMOS transistor NT1.

In the example of FIG. 9, resistors 300 are interposed between the gates of TFTs 114 in pixel circuits 101 and an interconnect 200 as a scan line WSL.

For the TFT closer to the output terminal of the buffer 1041 of the write scanner 104, the resistor having a larger resistance value is disposed (interposed).

It is desirable that the resistance values of the interposed resistors 300 be so designed that the sums between the interconnect resistance r×n of the interconnect from the scanner output terminal to the gate of the TFT and that of the interposed resistor 300 are equivalent to each other as much as possible.

For the resistor itself, an interconnect having a high resistance value, such as Mo (molybdenum), is available.

Figure 10:
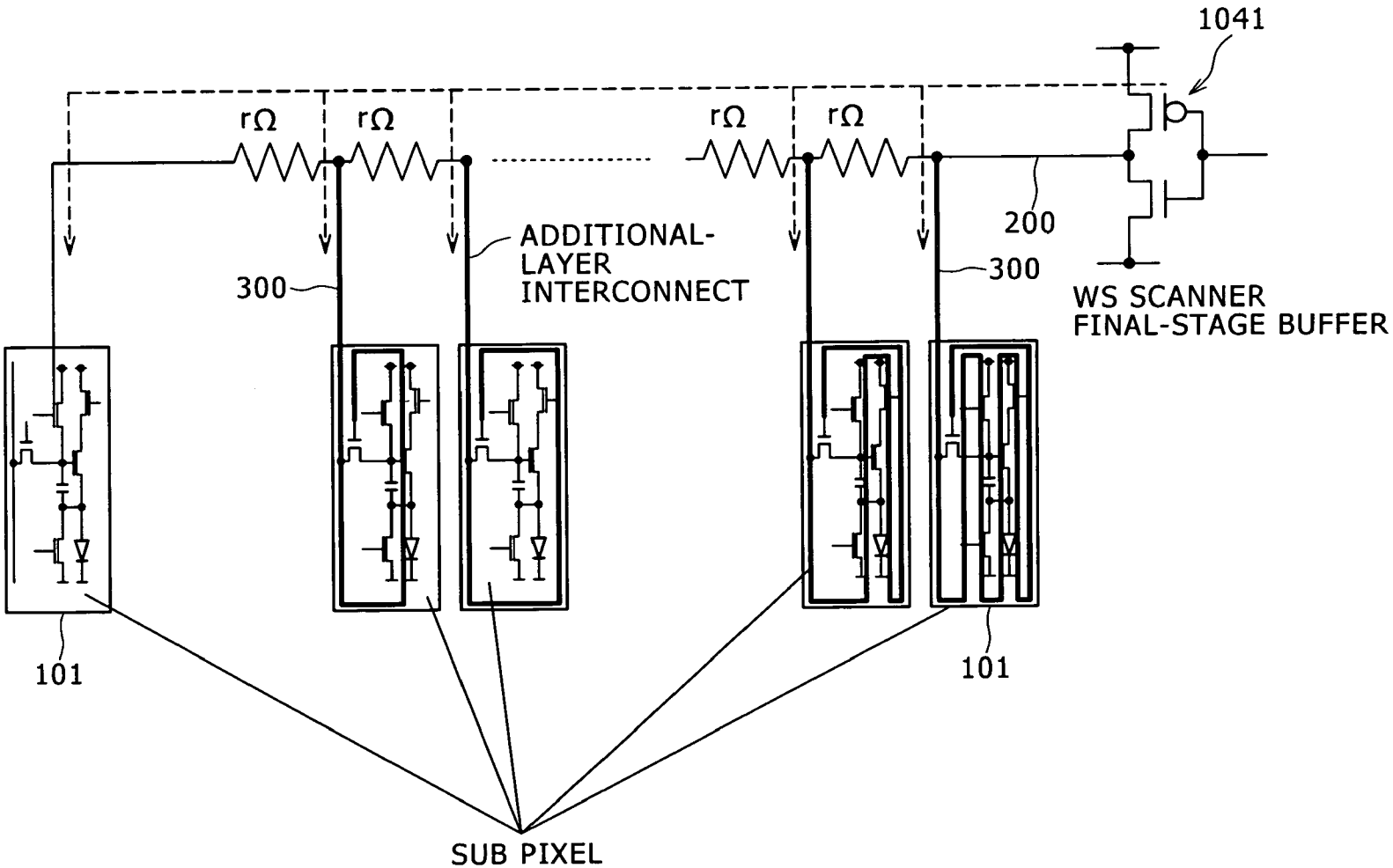
FIG. 10 is a diagram for explaining a second example of the countermeasure to suppress shading and streak unevenness.

FIG. 10 is a diagram for explaining a second example of the countermeasure to suppress shading and streak unevenness.

For suppression of shading and streak unevenness, a multi-layer interconnect may be used for gate interconnects and interconnects between gates.

If a multi-layer interconnect is used, as shown in FIG. 10, a large resistance interconnect length can be ensured.

Figure 11:
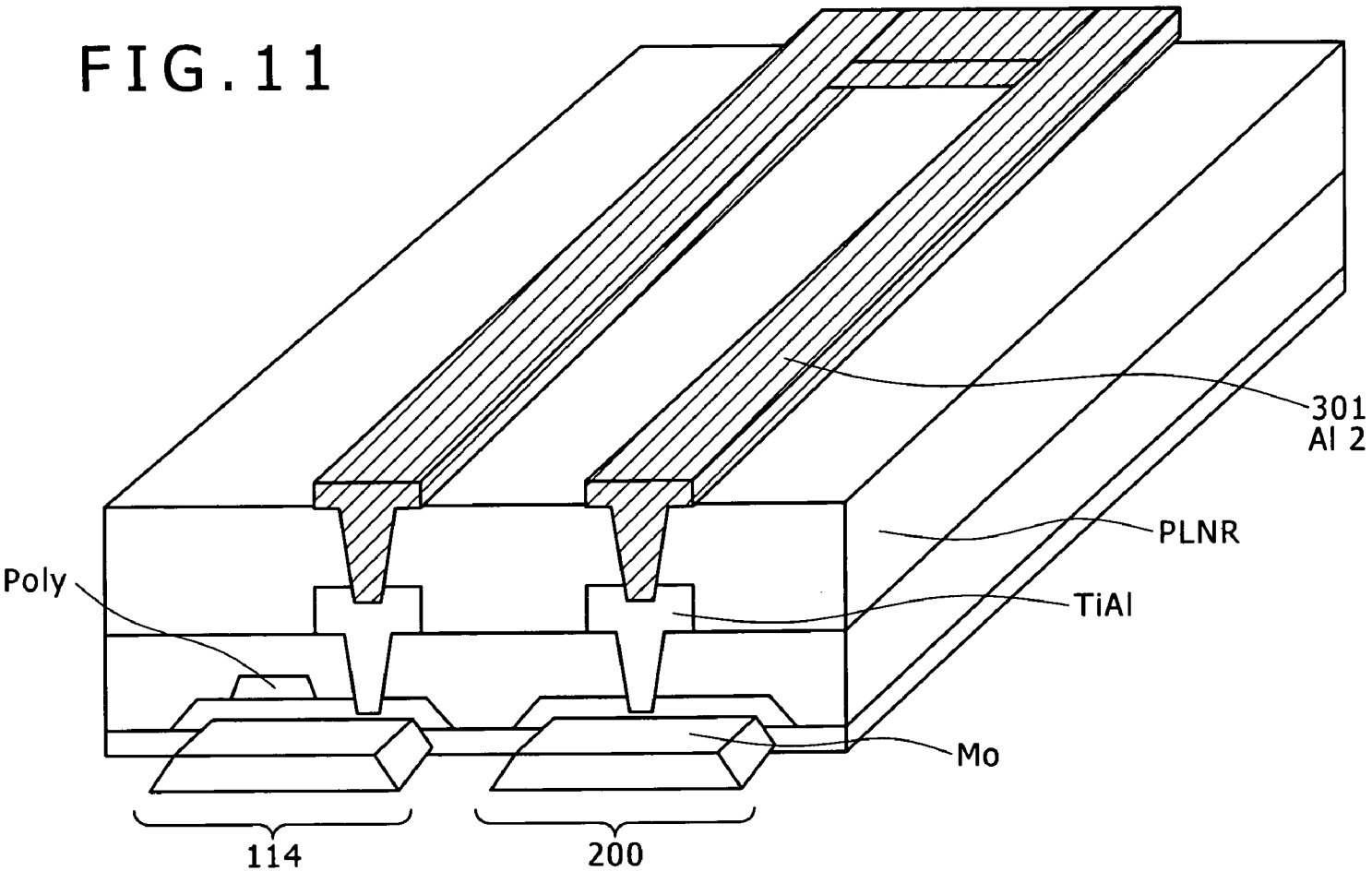
FIG. 11 is a diagram showing a configuration example of a multi-layer interconnect.

FIG. 11 is a diagram showing a configuration example of the multi-layer interconnect.

In this configuration, an interconnect part 200 is coupled to an upper additional layer 301 by TiAl or the like, and the additional layer 301 is connected to a gate part 114*a* of the TFT 114 via a contact. By varying the interconnect length and width of the additional layer 301, the resistance value is changed.

For the additional layer 301, Al or the like can be used. In this case, a typical TFT process can be used for the fabrication process.

Alternatively, Ag or the like may be used for the additional layer 301. In this case, a typical anode process can be used for the fabrication process.

The above-described first and second countermeasure examples can decrease the differences in the resistance value of the interconnect from the scanner output terminal to the transistor (TFT). As a result, shading and streak unevenness caused due to the resistance of the interconnect for gate pulses can be suppressed.

Figure 12:
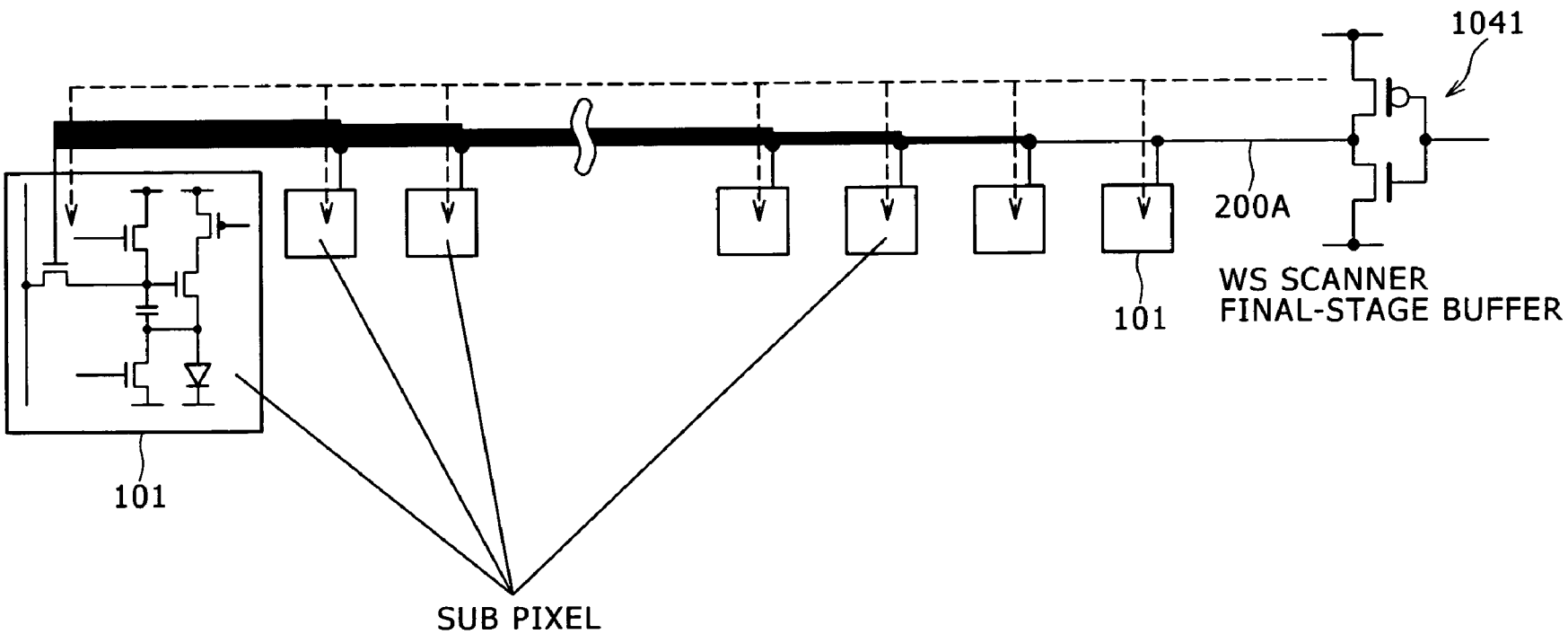
FIG. 12 is a diagram for explaining a third example of the countermeasure to suppress shading and streak unevenness.

FIG. 12 is a diagram for explaining a third example of the countermeasure to suppress shading and streak unevenness.

In this example, the width of an interconnect 200A is increased in linkage with increase in the distance from the output terminal of a buffer 1041 of a scanner.

Specifically, the interconnect from the output terminal to the gate pulse input terminals of TFTs (transistors) in pixel circuits 101 is divided into plural segments, and the segment remoter (farther away) from the scanner output terminal is formed to have a larger interconnect width.

Figure 13:
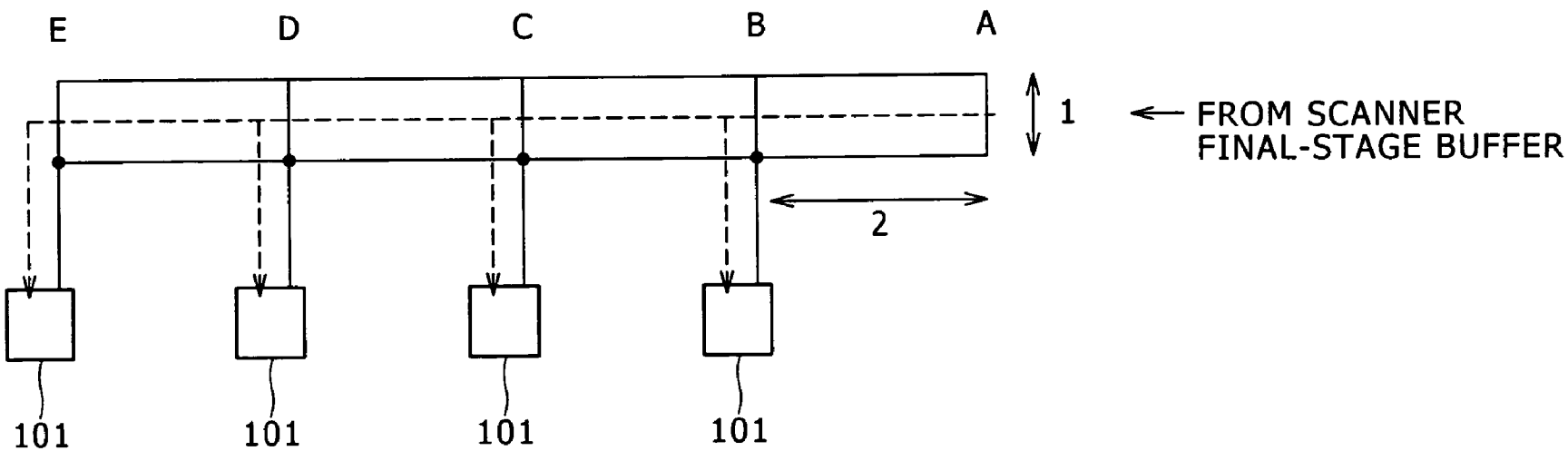
FIG. 13 is a diagram showing a typical interconnect example.
Figure 14:
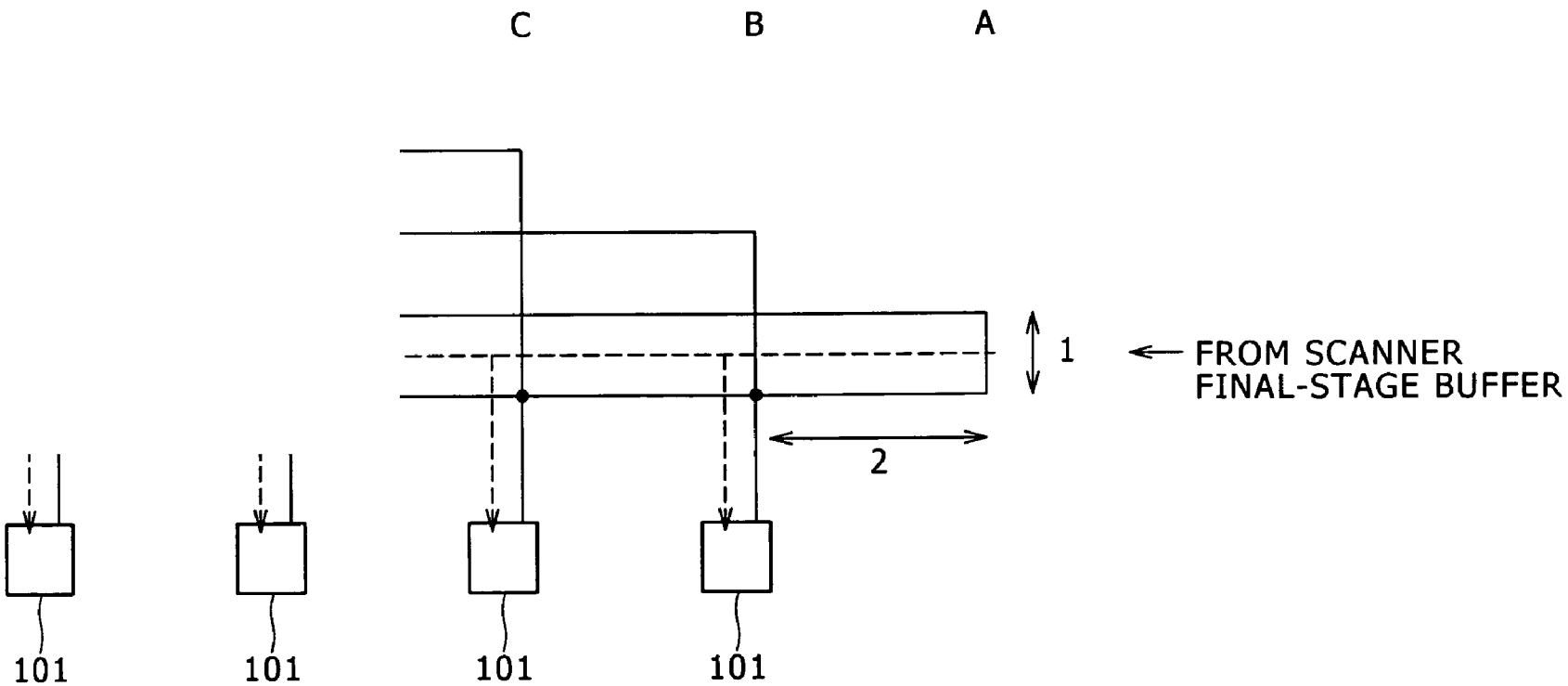
FIG. 14 is a diagram showing an example of an interconnect based on the third countermeasure example.

FIG. 13 is a diagram showing an example of a typical interconnect. FIG. 14 is a diagram showing an example of the interconnect based on the third countermeasure example.

In FIGS. 13 and 14, the interconnect from an output terminal to input terminals is divided into four segments, and the respective boundaries between the output terminal and the gate pulse input terminals are defined as A, B, C, D, and E.

In the typical example of FIG. 13, when regarding the interconnect, the width is defined as 1, the length of one segment is defined as 2, and the sheet resistance coefficient is defined as 1, the resistance values at the points B, C, D, and E are 2, 4, 6, and 8, respectively. Therefore, the resistance value of the interconnect to the pixel most remote from the output terminal is four times that of the interconnect to the closest pixel.

In contrast, in the interconnect example of FIG. 14 relating to the present embodiment, the width of an interconnect 300A for gate pulses is increased one by one on each segment basis in linkage with increase in the distance from the output terminal.

In this example, the resistance values at the points B, C, D, and E are 2, 3, 3.6, and 4.1, respectively. Therefore, the resistance value of the interconnect to the pixel remotest from the output terminal is twice that of the interconnect to the closest pixel, and thus the influence of the interconnect resistance value is smaller compared with the typical example.

The number of segments arising from interconnect division may be any optional value.

Figure 15:
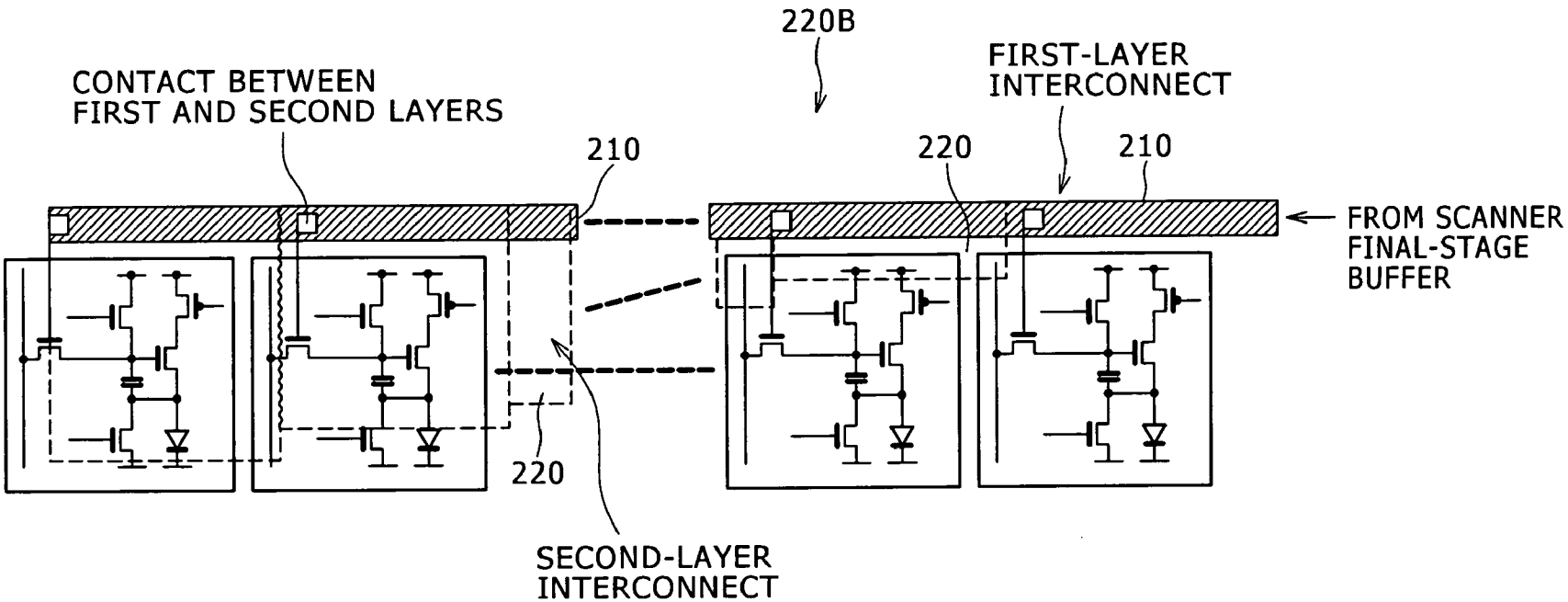
FIG. 15 is a diagram for explaining a fourth example of the countermeasure to suppress shading and streak unevenness.

FIG. 15 is a diagram for explaining a fourth example of the countermeasure to suppress shading and streak unevenness.

In this example, an interconnect 200B for transferring gate pulses is formed as interconnects on two layers. Of these interconnects, an interconnect 210 on one layer has uniform line width. In contrast, the width of an interconnect 220 on the other layer is increased in linkage with increase in the distance from the output terminal of a vertical scanner.

This can decrease the differences in the resistance value of the interconnect from the scanner output terminal to the transistor (TFT) merely through addition of one layer.

Figure 16:
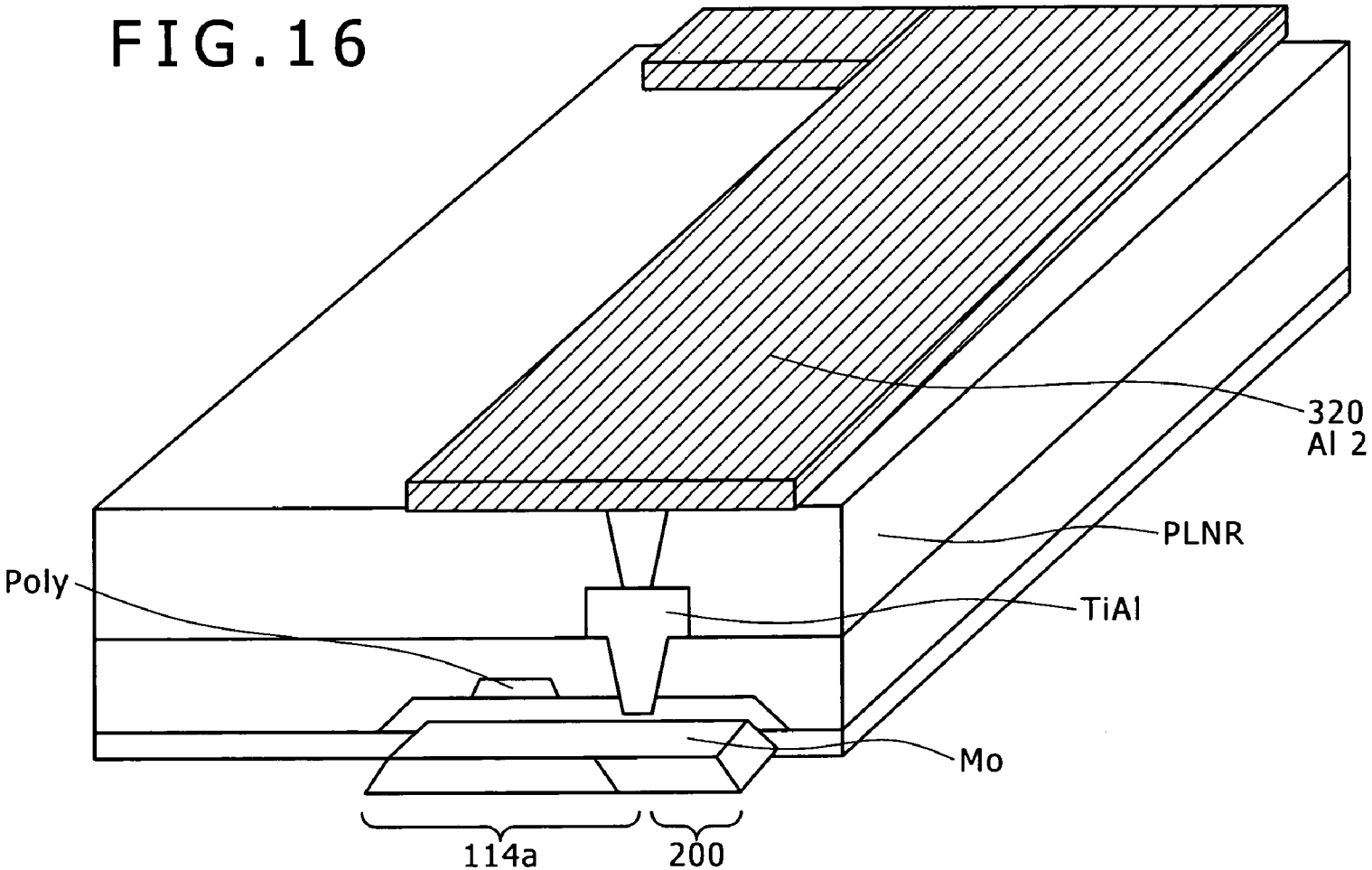
FIG. 16 is a diagram showing a second configuration example of a multi-layer interconnect.

FIG. 16 is a diagram showing a second configuration example of the multi-layer interconnect.

In this configuration, an interconnect part 200 is coupled to an upper additional layer 320 by TiAl or the like.

By varying the interconnect width of the additional layer 320, the resistance value is changed.

For the additional layer 320, Al or the like can be used. In this case, a typical TFT process can be used for the fabrication process.

Alternatively, Ag or the like may be used for the additional layer 320. In this case, a typical anode process can be used for the fabrication process.

Figure 17:
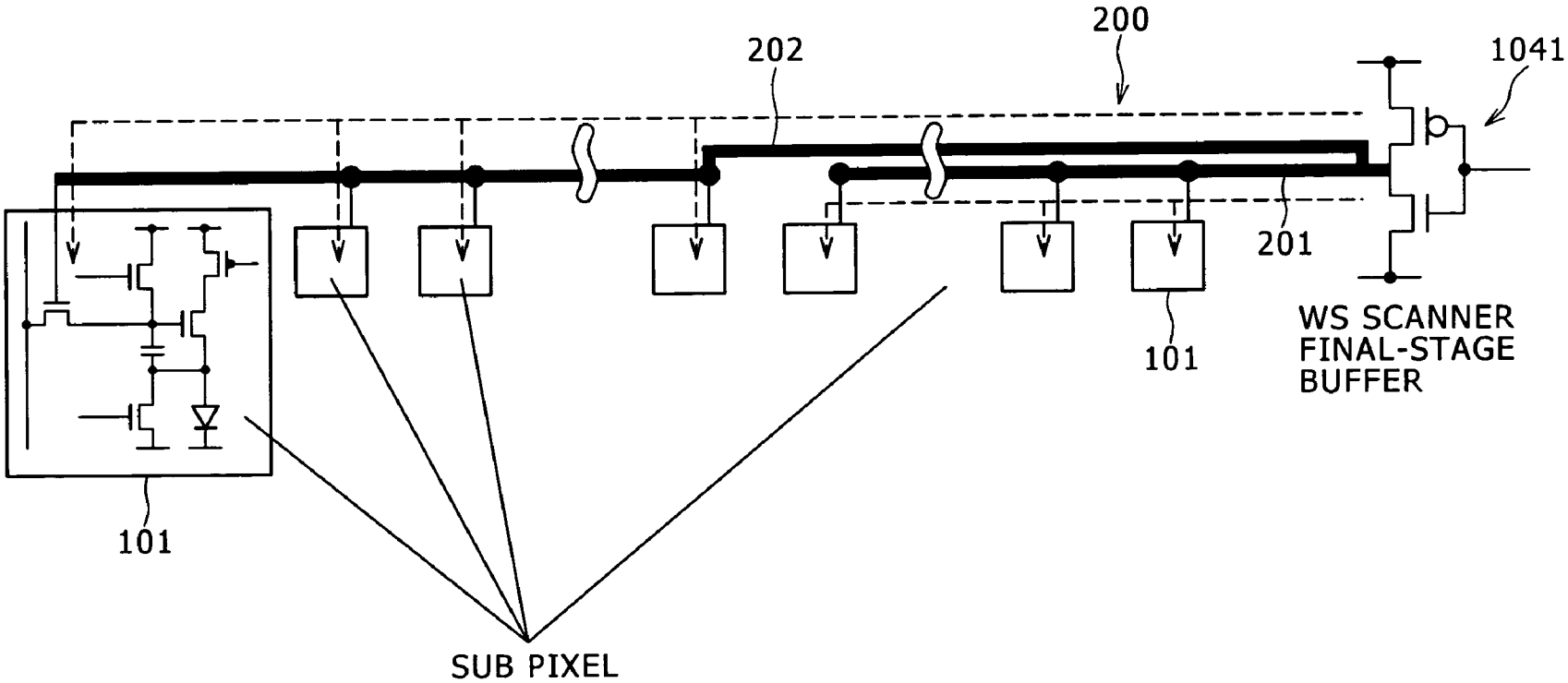
FIG. 17 is a diagram for explaining a fifth example of the countermeasure to suppress shading and streak unevenness.

FIG. 17 is a diagram for explaining a fifth example of the countermeasure to suppress shading and streak unevenness.

In FIG. 17, numeral 1041 denotes a buffer at the final stage (output stage) of a write scanner 104. This buffer is provided as a CMOS buffer formed of a PMOS transistor PT1 and an NMOS transistor NT1.

The example of FIG. 17 has a configuration in which a drive interconnect 200 connected to the buffer 1041 at the final stage (output stage) of the write scanner 104 is divided into two interconnects 201 and 202.

In the example of FIG. 17, the gate capacitance involved in the interconnect more remote from the scanner (farther interconnect) is half that of the pixels on one horizontal line, and thus a reduced load is achieved.

Furthermore, if the line width of the interconnect 202 more remote from the scanner is set larger than that of the interconnect closer to the scanner, the resistance differences can be decreased.

Figure 18:
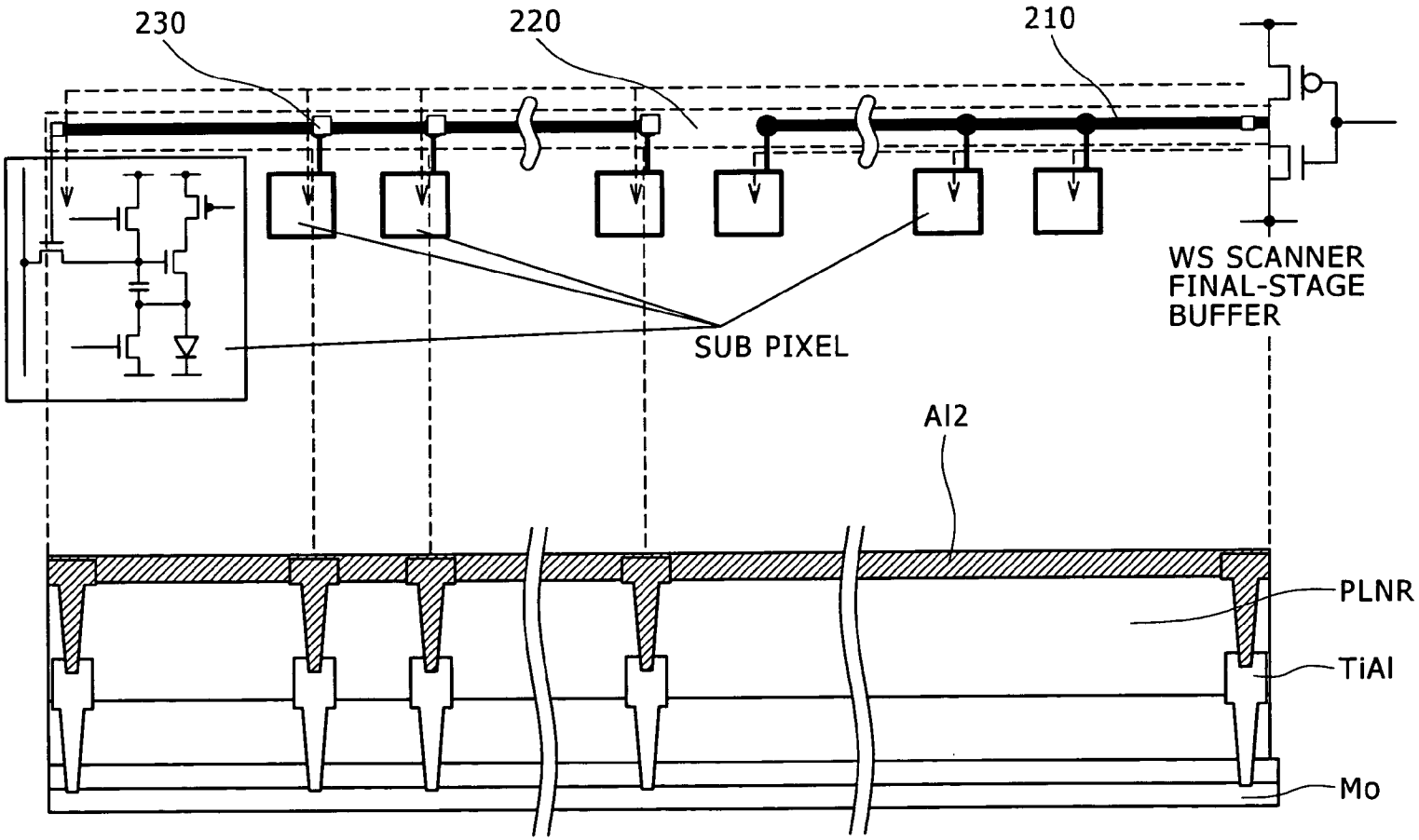
FIG. 18 is a diagram for explaining a sixth example of the countermeasure to suppress shading and streak unevenness.

FIG. 18 is a diagram for explaining a sixth example of the countermeasure to suppress shading and streak unevenness.

In the example of FIG. 18, a gate line is formed as interconnects 210 and 220 on two layers. To the interconnect more remote from a scanner, pulses (drive signals) are supplied by using the second-layer interconnect 220.

This can decrease the differences in the resistance value of the interconnect from the pulse output terminal of the scanner to the transistor (TFT) merely through addition of one layer.

For the multi-layer interconnect, Al or the like can be used for the additional layer. In this case, a typical TFT process can be used for the fabrication process.

Alternatively, Ag or the like may be used for the additional layer. In this case, a typical anode process can be used for the fabrication process.

The above-described fifth and sixth countermeasure examples can suppress shading and streak unevenness caused due to the resistance of the interconnect for gate pulses.

The operation of the above-described configurations will be described below with a focus on the operation of a pixel circuit in association with FIGS. 19A to 19F.

Figures 19A, 19B, 19C, 19D, 19E, 19F:
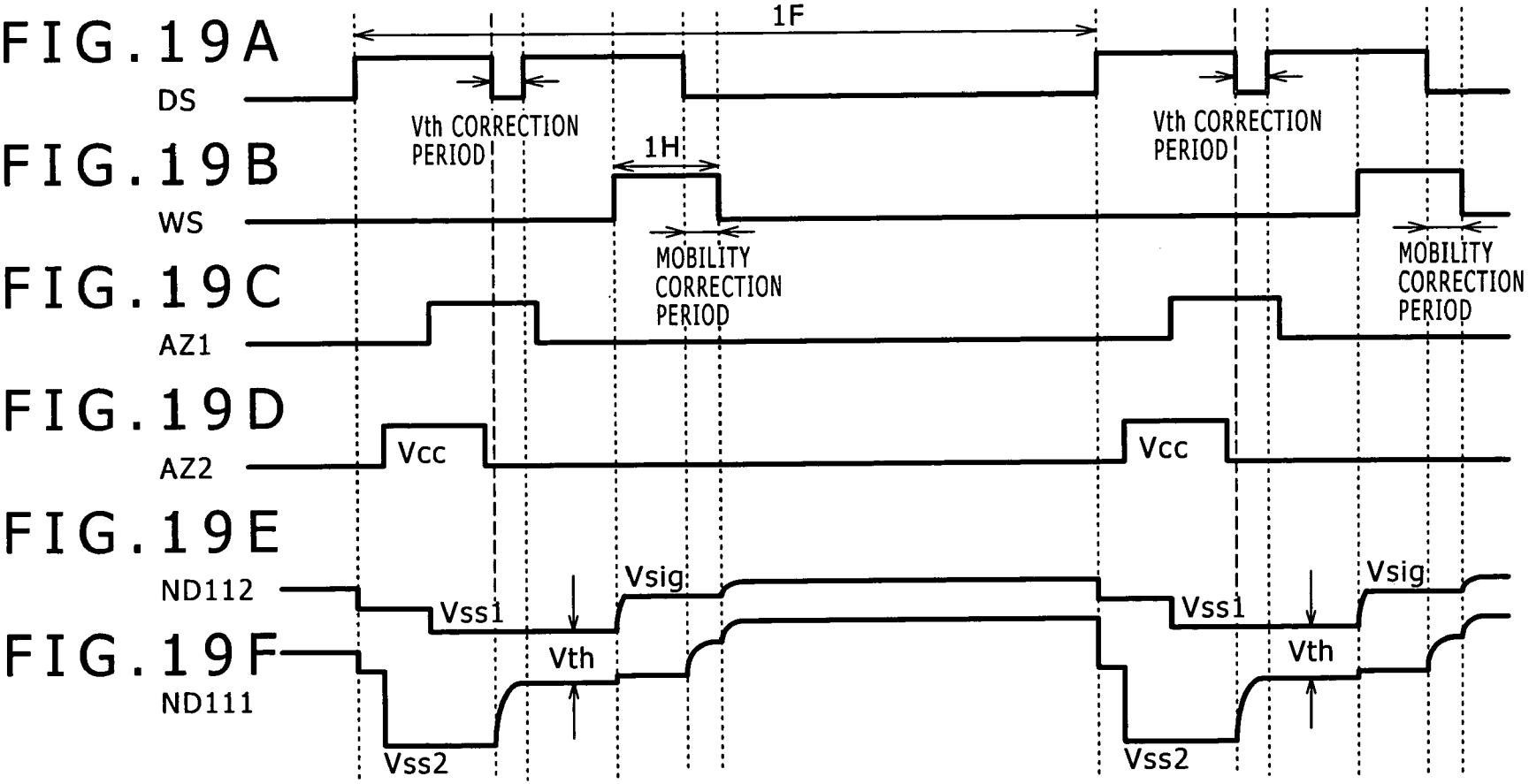
FIGS. 19A to 19F are a timing chart for explaining the operation of the embodiment.

FIG. 19A shows a drive signal DS applied to the drive line DSL, and FIG. 19B shows a drive signal WS applied to the scan line WSL. FIG. 19C shows a drive signal AZ1 applied to the first auto-zero line AZL1, and FIG. 19D shows a drive signal AZ2 applied to the second auto-zero line AZL2. FIG. 19E shows the potential at the second node ND112, and FIG. 19F shows the potential at the first node ND111.

Initially, the drive signal DS applied to the drive line DSL by the drive scanner 105 is kept at the high level, and the drive signal WS applied to the scan line WSL by the write scanner 104 is kept at the low level. Furthermore, the drive signal AZ1 applied to the auto-zero line AZL1 by the auto-zero circuit 106 is kept at the low level, and the drive signal AZ2 applied to the auto-zero line AZL2 by the auto-zero circuit 107 is kept at the high level.

As a result, the TFT 113 is turned on. At this time, a current flows via the TFT 113, so that the source potential Vs of the TFT 112 (potential at the node ND111) falls down to Vss2. Thus, the voltage applied to the EL light-emitting element 116 becomes zero, and hence the EL light-emitting element 116 does not emit light.

In this state, even when the TFT 114 is turned on, the voltage held by the capacitor C111, i.e., the gate voltage of the TFT 112, does not change.

Subsequently, as shown in FIGS. 19C and 19D, in the period during which the EL light-emitting element 116 does not emit light, the drive signal AZ1 to the auto-zero line AZL1 is turned to the high level with the drive signal AZ2 to the auto-zero line AZL2 kept at the high level. This changes the potential at the second node ND112 to Vss1.

Subsequently, the drive signal AZ2 to the auto-zero line AZL2 is switched to the low level, and then the drive signal DS applied to the drive line DSL by the drive scanner 105 is switched to the low level during a predetermined period.

Thus, the TFT 113 is turned off, while the TFTs 115 and 112 are turned on. This causes a current to flow through the path of the TFTs 112 and 111, which raises the potential at the first node.

Subsequently, the drive signal DS applied to the drive line DSL by the drive scanner 105 is switched to the high level, and the drive signal AZ1 is switched to the low level.

As the result of the above-described operation, the threshold voltage Vth of the drive transistor 112 is corrected, so that the potential difference between the second node ND112 and the first node ND111 becomes Vth.

In this state, after the elapse of a predetermined period, the drive signal WS applied to the scan line WSL by the write scanner 104 is kept at the high level during a predetermined period, so that data is written to the node ND112 via the data line. Furthermore, in the period during which the drive signal WS is at the high level, the drive signal DS applied to the drive line DSL by the drive scanner 105 is switched to the low level, and then the drive signal WS is switched to the low level.

At this time, the TFT 112 is turned on, and the TFT 114 is turned off, so that mobility correction is carried out.

In this case, the voltage between the gate and source of the TFT 112 is constant because the TFT 114 is in the off-state. Therefore, the TFT 112 applies a constant current Ids to the EL light-emitting element 116. This raises the potential at the first node ND111 to a voltage Vx that causes the current Ids to flow through the EL light-emitting element 116, so that the EL light-emitting element 116 emits light.

Also in the present circuit, the current-voltage (I-V) characteristic of the EL element changes as the total emission time thereof becomes longer. Therefore, the potential at the first node ND111 also changes. However, because the voltage Vgs between the gate and source of the TFT 112 is kept at a constant value, the current flowing through the EL light-emitting element 116 does not change. Therefore, even when the I-V characteristic of the EL light-emitting element 116 deteriorates, the constant current Ids invariably continues to flow, and hence, the luminance of the EL light-emitting element 116 does not change.

For the thus driven pixel circuits, the countermeasure against shading and streak unevenness attributed to delay caused by the resistance of the interconnect for drive signals (pulses) is implemented across the entire panel. This can achieve high-quality images in which the occurrence of shading and streak unevenness is suppressed.

It should be understood by those skilled in the art that various modifications, combinations, sub-combinations and alterations may occur depending on design requirements and other factors insofar as they are within the scope of the appended claims or the equivalents thereof.

What is claimed is:

1. A display comprising:

a plurality of pixel circuits configured to be arranged in a matrix and each include at least one transistor of which the conduction state is controlled through reception of a drive signal to a control terminal;

a scanner configured to output a drive signal to the control terminals of the transistors included in the pixel circuits; and a drive interconnect configured to be connected to the control terminals of the transistors in the pixel circuits in common and allow transmission of a drive signal output by the scanner, wherein the drive interconnect includes a configuration that averages signal delay due to interconnect resistance differences dependent upon a distance from a drive signal output terminal of the scanner, wherein:

a line width of the drive interconnect is increased in linkage with increase in a distance from the drive signal output terminal of the scanner, the drive interconnect is formed as interconnects on two layers, and a line width of a whole of the interconnect on one layer is uniform, and a line width of the interconnect on the other layer is increased in linkage with increase in a distance from the drive signal output terminal of the scanner.

2. The display according to claim 1, wherein resistors are each disposed between the drive interconnect and the control terminal of a corresponding one of the transistors.

3. The display according to claim 2, wherein a resistance value of the resistor closer to the drive signal output terminal of the scanner is set higher.

4. The display according to claim 3, wherein the resistors are formed of a multi-layer interconnect.

5. The display according to claim 1, wherein the drive interconnect is divided into a plurality of segments, and a line width of the segment more remote from the drive signal output terminal of the scanner is set larger.

6. A display comprising:

a plurality of pixel circuits configured to be arranged in a matrix and each include a transistor of which the conduction state is controlled through reception of a drive signal to a gate;

data lines configured to be disposed along columns of the matrix of the pixel circuits and be supplied with a data signal in accordance with luminance information;

first, second, third, and fourth scanners configured to output a drive signal to the gates of the transistors included in the pixel circuits;

first, second, third, and fourth drive interconnects configured to be connected to the gates of the transistors in the pixel circuits on the same row in common and allow transmission of a drive signal output by the first, second, third, and fourth scanners, respectively; and first, second, third, and fourth reference potentials;

each of the pixel circuits including an electro-optical element of which luminance changes depending on a current that flows through the electro-optical element, first and second nodes, a pixel capacitance element connected between the first node and the second node, a drive transistor that forms a current supply line between a drain terminal and a source terminal, and controls a current flowing through the current supply line depending on a potential of a gate connected to the second node, a first switch transistor connected between the first reference potential and the drain terminal of the drive transistor, a second switch transistor connected between the first node and the third reference potential, a third switch transistor connected between the second node and the fourth reference potential, and a fourth switch transistor connected between the data line and the second node, wherein the first switch transistor, the current supply line of the drive transistor, the first node, and the electro-optical element are connected in series to each other between the first reference potential and the second reference potential, the first drive interconnect is connected to a gate of the first switch transistor, the second drive interconnect is connected to a gate of the fourth switch transistor, the third drive interconnect is connected to a gate of the second switch transistor, and the fourth drive interconnect is connected to a gate of the third switch transistor, and at least one drive interconnect out of the first to fourth drive interconnects includes a configuration that averages signal delay due to interconnect resistance differences dependent upon a distance from a drive signal output terminal of the scanner.

7. The display according to claim 6, wherein resistors are each disposed between the drive interconnect and the gate of a corresponding one of the transistors.

8. The display according to claim 7, wherein a resistance value of the resistor closer to the drive signal output terminal of the scanner is set higher.

9. The display according to claim 8, wherein the resistors are formed of a multi-layer interconnect.

10. The display according to claim 6, wherein a line width of the drive interconnect is increased in linkage with increase in a distance from the drive signal output terminal of the scanner.

11. The display according to claim 10, wherein the drive interconnect is divided into a plurality of segments, and a line width of the segment remoter from the drive signal output terminal of the scanner is set larger.

12. The display according to claim 10, wherein the drive interconnect is formed as interconnects on two layers, and a line width of a whole of the interconnect on one layer is uniform, and a line width of the interconnect on the other layer is increased in linkage with increase in a distance from the drive signal output terminal of the scanner.

13. A display comprising:

a plurality of pixel circuits configured to be arranged in a matrix and each includes a transistor of which conduction state is controlled through reception of a drive signal to a gate;

data lines configured to be disposed along columns of the matrix of the pixel circuits and be supplied with a data signal in accordance with luminance information;

first, second, third, and fourth scanners configured to output a drive signal to the gates of the transistors included in the pixel circuits;

first, second, third, and fourth drive interconnects configured to be connected to the gates of the transistors in the pixel circuits on the same row in common and allow transmission of a drive signal output by the first, second, third, and fourth scanners, respectively; and first, second, third, and fourth reference potentials;

each of the pixel circuits including an electro-optical element of which luminance changes depending on a current that flows through the electro-optical element, first and second nodes, a pixel capacitance element connected between the first node and the second node, a drive transistor that forms a current supply line between a drain terminal and a source terminal, and controls a current flowing through the current supply line depending on a potential of a gate connected to the second node, a first switch transistor connected between the first reference potential and the drain terminal of the drive transistor, a second switch transistor connected between the first node and the third reference potential, a third switch transistor connected between the second node and the fourth reference potential, and a fourth switch transistor connected between the data line and the second node, wherein the first switch transistor, the current supply line of the drive transistor, the first node, and the electro-optical element are connected in series to each other between the first reference potential and the second reference potential, the first drive interconnect is connected to a gate of the first switch transistor, the second drive interconnect is connected to a gate of the fourth switch transistor, the third drive interconnect is connected to a gate of the second switch transistor, and the fourth drive interconnect is connected to a gate of the third switch transistor, and at least one drive interconnect out of the first to fourth drive interconnects is divided into a plurality of interconnects along an interconnect direction.

14. The display according to claim 13, wherein one end of each of the plurality of interconnects is connected to a drive signal output terminal of the scanner.

15. The display according to claim 13, wherein the drive interconnect is formed as interconnects on two layers, and a drive signal is supplied via the interconnect on a second layer to an interconnect that arises from division and is connected to the gates.

* * * * *